US005453020A

United States Patent [19]

Bray et al.

[11] Patent Number: 5,453,020

[45] Date of Patent: Sep. 26, 1995

[54] SNAP-ON ELECTRICAL CONNECTOR FOR BASELESS CARTRIDGE BULB WITH ELECTRICAL CABLE PIERCER

[75] Inventors: Douglas R. Bray, Medford, N.J.; Michael M. Strazhnik, Philadelphia, Pa.

[73] Assignee: Seal Gull Lighting, Riverside, N.J.

[21] Appl. No.: 292,983

[22] Filed: Aug. 19, 1994

[51] Int. Cl.[6] ..... H01R 4/24

[52] U.S. Cl. ..... 439/239; 439/419

[58] Field of Search ..... 439/419, 658, 439/425, 121, 239, 698

[56] References Cited

U.S. PATENT DOCUMENTS

| | | | |
|---|---|---|---|
| D. 344,262 | 2/1994 | Bray | D13/134 |
| 3,633,149 | 1/1972 | Maltais . | |
| 4,159,157 | 6/1979 | Koehler . | |
| 4,429,945 | 2/2984 | Nestor . | |
| 4,855,882 | 8/1989 | Boss | 362/238 |
| 4,938,708 | 7/1990 | Vigneau et al. | 439/239 |
| 4,938,709 | 7/1990 | Smith et al. | 439/239 |
| 5,045,981 | 9/1991 | Nagano | 362/219 |
| 5,149,449 | 8/1992 | Tieszen | 439/419 |
| 5,280,417 | 1/1994 | Hall et al. | 362/226 |

OTHER PUBLICATIONS

Ambiance Landscape Lighting System catalog, Supplement No. AMB–93 LC, Sea Gull Lighting Products, Inc., Riverside, N.J., 1993, pp. 18–19.

Sea Gull Lighting Products, Inc. 1993 catalog, Riverside, N.J., 1993, pp. 59, 164 and 165.

*Primary Examiner*—Gary F. Paumen

*Attorney, Agent, or Firm*—Seidel Gonda Lavorgna & Monaco

[57] ABSTRACT

An electrical connection assembly for a baseless cartridge bulb includes two electrical connectors attached to a housing. The housing includes tabs which snap onto a channel partially surrounding a pair of insulated electrical cables. One end of each of the connectors includes a spring tab for accepting a loop contact pin of a cartridge bulb. The other end includes a spiked prong for piercing the cable insulation and becoming embedded therein.

31 Claims, 4 Drawing Sheets

SNAP-ON ELECTRICAL CONNECTOR FOR BASELESS CARTRIDGE BULB WITH ELECTRICAL CABLE PIERCER

FIELD OF THE INVENTION

This invention relates to a snap-on type electrical connector assembly which makes electrical connection to insulated electrical cables through spiked prongs, and more particularly to such an assembly for use with a "baseless" cartridge bulb.

BACKGROUND OF THE INVENTION

Snap-on electrical connectors for light fixtures are known in the art. In one prior art scheme, a connector assembly includes a nonconductive elongated U-shaped or channel-shaped housing which snaps onto a channel partially surrounding a pair of insulated electrical cables. The housing is defined by a base and sidewalls. The sidewalls of the housing snap onto the channel. The base includes a lower surface which faces the cables. Electrical connectors are attached to the lower surface of the housing. Such electrical connector is a unitary conductive piece including a base portion, a terminal portion and a spiked prong. The base portion of the connector lies flush and exposed against the lower surface of the base of the housing and the spiked prongs extend outward from each of the electrical connectors. The prongs are arranged so that each prong will align with one of the two insulated electrical cables when the housing is snapped over the channel surrounding the cables. An electrical wire is attached to a terminal at a distal end of the terminal portion by crimping, or the like. The electrical wire connects to one end of the bulb socket of the light fixture. When the housing is snapped over the channel, each of the spiked prongs pierces the insulation of a respective cable and become embedded within the cable. This causes the terminals, and thus the light fixture bulb socket, to be in electrical contact with the cables.

One disadvantage of this prior art scheme is that an electrical wire is required to connect the electrical connector to the light bulb socket, even when the light bulb is a baseless cartridge bulb. The use of the electrical wire creates potential connection problems and increases assembly time, cost and complexity, and potentially impairs reliability.

Baseless cartridge bulb sockets are also known in the art. Examples of such sockets are shown in U.S. Pat. Nos. 3,633,149, 4,429,945, 4,938,708 and 4,938,709. The electrical connectors in those patents do not include spiked prongs. Instead, electrical connection is made between the connector and the electrical cable by crimping, or the like.

There is still a need for a snap-on baseless cartridge bulb socket which can be connected to electrical cables by spiked prongs, which completely eliminates the need for crimping, and which is simple to install and fabricate. The present invention fills that need.

SUMMARY OF THE INVENTION

The present invention provides a baseless cartridge bulb socket assembly for attachment to a pair of insulated electrical cables. The assembly comprises a nonconductive housing including a base and two electrical connectors supported by the base. The two electrical connectors receive therebetween a cartridge bulb in electrical connection between the cables. Each connector is a unitary conductive piece and includes a spring tab portion, a base portion and a spiked prong. The spring tab portion has a distal end for accepting a contact pin of a cartridge bulb and a proximal end. The base portion has first and second ends, the first end meeting the proximal end of the spring tab portion. The spiked prong extends outwardly from the base portion. The spiked prong pierces the insulation of one of the pair of cables when the assembly is brought into contact with the cables and makes conductive contact with one of the pair of cables.

In another embodiment, the invention provides a baseless cartridge bulb socket assembly for attachment to a channel holding a pair of insulated electrical cables. The assembly comprises a nonconductive housing and two electrical connectors. The nonconductive housing includes a base and sidewalls. The sidewalls attach to the channel. The two electrical connectors are supported by the base and receive therebetween a cartridge bulb in electrical connection between the cables. Each connector is a unitary conductive piece and includes a spring tab portion, a base portion and a spiked prong. The spring tab portion has a distal end for accepting a contact pin of a cartridge bulb and a proximal end. The base portion has first and second ends, the first end meeting the proximal end of the spring tab portion. The spiked prong extends outwardly from the base portion. The spiked prong pierces the insulation of one of the pair of cables when the assembly is attached to the channel and makes conductive contact with said one of the pair of cables.

In yet another embodiment, the invention provides a baseless cartridge bulb socket assembly for attachment to a channel holding a pair of insulated electrical cables. The assembly comprises a nonconductive channel engaging member having a longitudinal axis and two electrical connectors supported by the engaging member. The electrical connectors receive therebetween a cartridge bulb in electrical connection between the cables. Each connector is a unitary conductive piece and includes a spring tab portion, a base portion and a spiked prong. The spring tab portion has a distal end for accepting a contact pin of a cartridge bulb and a proximal end. The planar base portion has first and second ends, the first end meeting the proximal end of the spring tab portion. The base portion extends parallel to the member's longitudinal axis. The spiked prong extends outwardly from the base portion. The prong pierces the insulation of one of the pair of cables when the assembly is attached to the channel and makes conductive contact with said one of the pair of cables.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE PREFERRED EMBODIMENT

Figure 1:
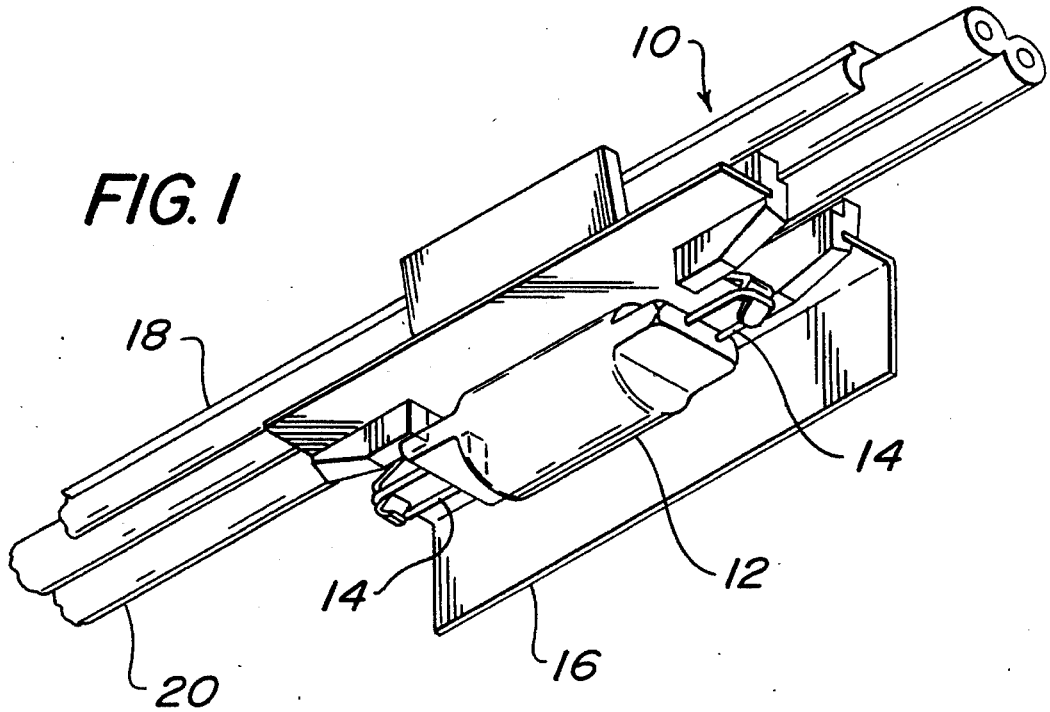
FIG. 1 is perspective view of one preferred form of a baseless cartridge bulb socket assembly in accordance with the present invention shown mounted on an electrical cable channel with a bulb attached thereto.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Apparatus depicting the preferred embodiment of the novel bulb socket assembly is illustrated in the drawings.

Turning first to FIG. 1, a bulb socket assembly 10 is shown with bulb 12 attached thereto by loop-type contact pins 14. The bulb 12 is a standard baseless cartridge bulb, as known in the art. The assembly 10 is also shown with optional reflector 16 mounted therein. The assembly 10 is mounted on channel 18 which surrounds electrical cables 20.

Figure 3:
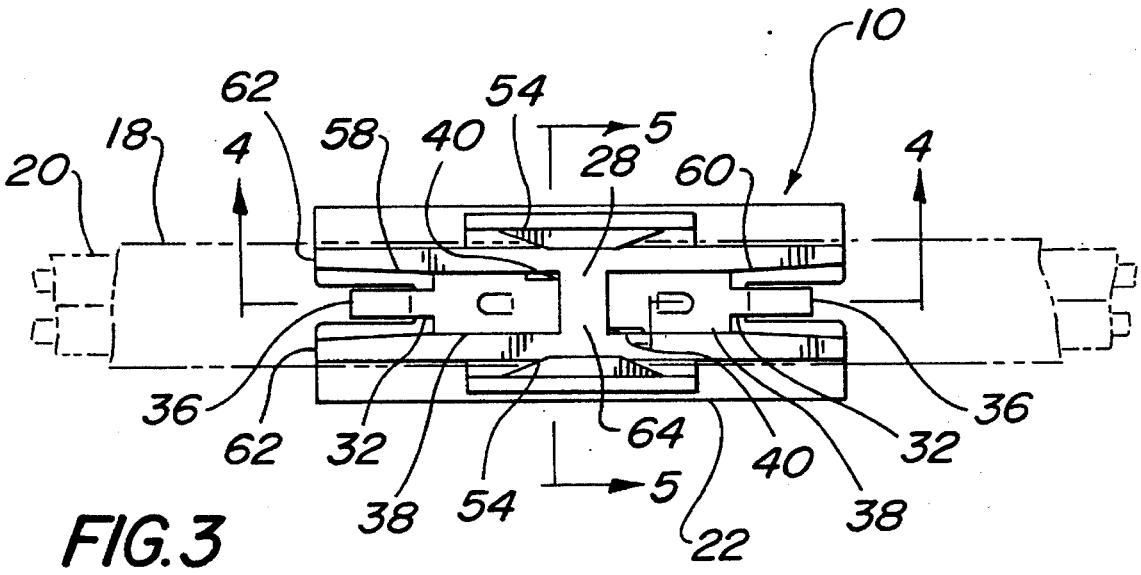
FIG. 3 is a bottom view of the bulb socket assembly, showing the channel and electrical cables in phantom.
Figure 2:
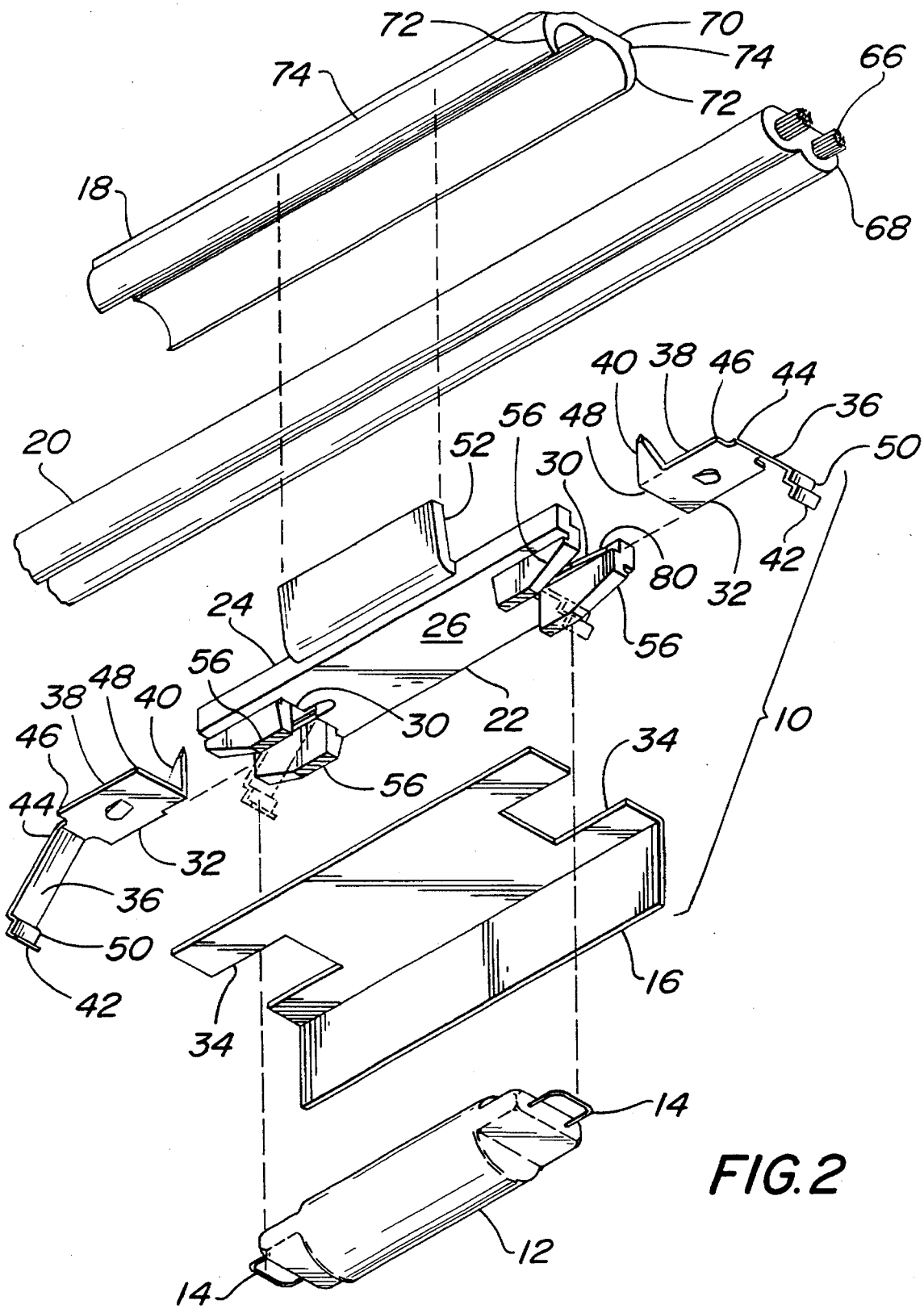
FIG. 2 is an exploded view of the bulb socket assembly in FIG. 1.

FIG. 2 shows an exploded view of FIG. 1 and more clearly illustrates the parts of the socket assembly 10 and how it attaches to the channel 18 and the cables 20. FIG. 3 is a bottom view of the assembly 10 and shows the channel 18 and the electrical cables 20 in phantom. For clarity, FIGS. 2 and FIG. 3 will be described together.

The assembly 10 includes a nonconductive channel-shaped housing 22. The housing 22 has a base 24 with an upper surface 26 facing the bulb 12 and a lower surface 28 adjacent and facing the electrical cables 20. FIG. 2 best illustrates the upper surface 26 and FIG. 3 best illustrates the lower surface 28. The base 24 has an overall rectangular dimension which is slightly larger than the overall dimensions of the cartridge bulb 12 mounted thereon. The base 24 includes cut-outs 30 on either side for allowing an upstanding portion of an electrical connector 32 to fit therebetween, as described below. The reflector 16 has cut-outs 34 which generally match the shape of the cut-outs 30.

An important feature of the invention is the electrical connectors 32 which are formed of conductive material, such as metal. The connectors 32 are identical, unitary pieces. Each connector 32 includes a spring tab portion 36, a planar base portion 38 and a spiked prong 40. The spring tab portion 36 has a distal end 42 and a proximal end 44. The base portion 38 has a first end 46 and a second end 48. A seating notch 50 is disposed near the distal end 42 of the spring tab portion 36 for accepting the loop contact pin 14 of the cartridge bulb 12. The proximal end 44 of the spring tab portion 36 meets the first end 46 of the base portion 38. The spiked prong 40 extends perpendicularly from the base portion 38 towards one of the electrical cables 20. In the embodiment shown in FIGS. 2 and 3, the prong 40 extends from a corner of the base portion's second end 48. Each of the prongs achieves conductive contact with a different one of the cables 20 when the assembly 10 is snapped into place.

The prior art electrical connectors for cartridge bulb sockets described in the background of the invention end at a wire crimping terminal. Likewise, the prior art spiked prong connector described in the background of the invention also ends at a wire crimping terminal. In contrast, the electrical connector 32 described herein terminates at one end with a cartridge bulb seating notch and at the other end with a spiked prong. Thus, the bulb socket assembly described herein can be attached to electrical cables without any tools.

Turning again to FIGS. 2 and FIG. 3, the housing 22 also includes opposed tabs or sidewalls 52 extending outward and upward (as oriented in FIG. 2) from edges of the base 24. Only one tab 52 is visible in FIG. 2. The far ends of the tabs 52 include short inwardly facing projections 54 (best shown in FIG. 5) which locks the tabs 52 to the channel 18.

Two pairs of bosses or rails 56 extend outward and downward (as oriented in FIG. 2) from the corners of the upper surface 26 of the housing 22. The rails 56 retain the optional reflector 16. The reflector 16 is attached to the housing 22 by positioning the reflector cut-outs 34 around the rails 56 and snapping the reflector 16 in place against the upper surface 26 of the housing 22.

Figure 6:
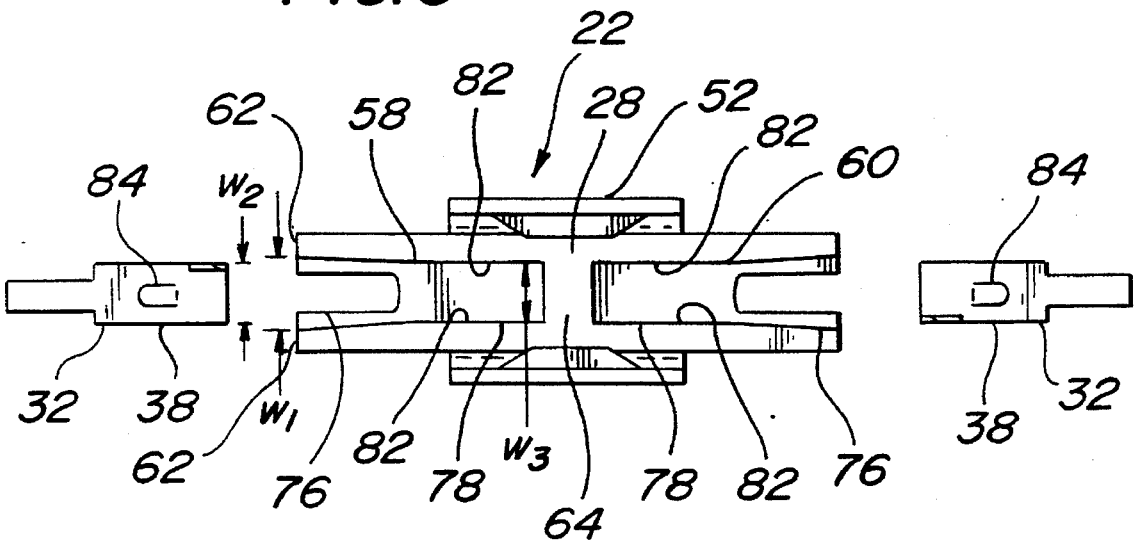
FIG. 6 is a bottom view of the housing portion of the bulb socket assembly shown in FIG. 3, with the connectors exploded from the housing.

The lower surface 28 of the housing 22 includes impressions or grooved regions 58 and 60. Regions 58 and 60 also include the area of the housing 22 hidden underneath the base portions 38 of the electrical connectors 32. (FIG. 6 shows an unobstructed view of the regions 58 and 60.) The grooved regions 58 and 60 give the lower surface 28 the appearance of having a pair of tracks 62 extending along the length of the housing 22 with the base portion 38 of the electrical connectors 32 mounted therebetween. Middle region 64 of the lower surface 28 is not grooved, and thus lies in the same plane as the tracks 62. It gives the appearance of a cross-tie between the tracks 62. The region 64 acts as a stop for the base portion 38 of each of the electrical connectors 32 as they are put into place.

As noted above (and shown in FIG. 3), each of the electrical connectors 32 are attached to housing 22 through the connector's base portion 38. Each base portion 38 lies in the grooved regions 58 and 60, between tracks 62. The widths of the grooved regions 58, 60 and the tracks 62 are dimensioned so that the base portion 58 can be easily slipped into place and also tightly held in place after insertion, as described below with respect to FIG. 6.

FIG. 2 also shows the assembly 10 exploded from electrical cables 20 and channel 18. The electrical cables 20 include conductive wiring 66 surrounded by an outer sheath of insulation 68. Channel 18 includes a base portion 70, shoulders 72 and shoulder grooves 74 formed in each shoulder 72. The electrical cables 20 are either slid or snapped into the channel 18 to form a subassembly before the bulb socket assembly 10 is snapped into place. Final assembly involves press fitting tabs 52 over the channel's shoulders 72 until the tab's projections 54 slip into the shoulder grooves 74, thereby locking the tabs 52 in place. As the assembly 10 is pressed into place, the spiked prongs 40 push through the insulation 68 and penetrate or sink into the conductive wiring 66.

Although the embodiment of the invention shown in FIG. 2 has spiked prongs 40 extending from a corner of the second end 48 of the base portion 38, the prong 40 could extend from any region of the base portion 38. However, by placing the prong 40 at a corner of the second end 48, the prong 40 becomes braced against a track 62 and an edge of the middle region 64 of the housing lower surface 28 when the electrical connector 32 is attached thereto. This positioning inhibits undesired lateral flexing of the prong 40 when it pushes into and pierces the electrical cables 20.

Figure 4:
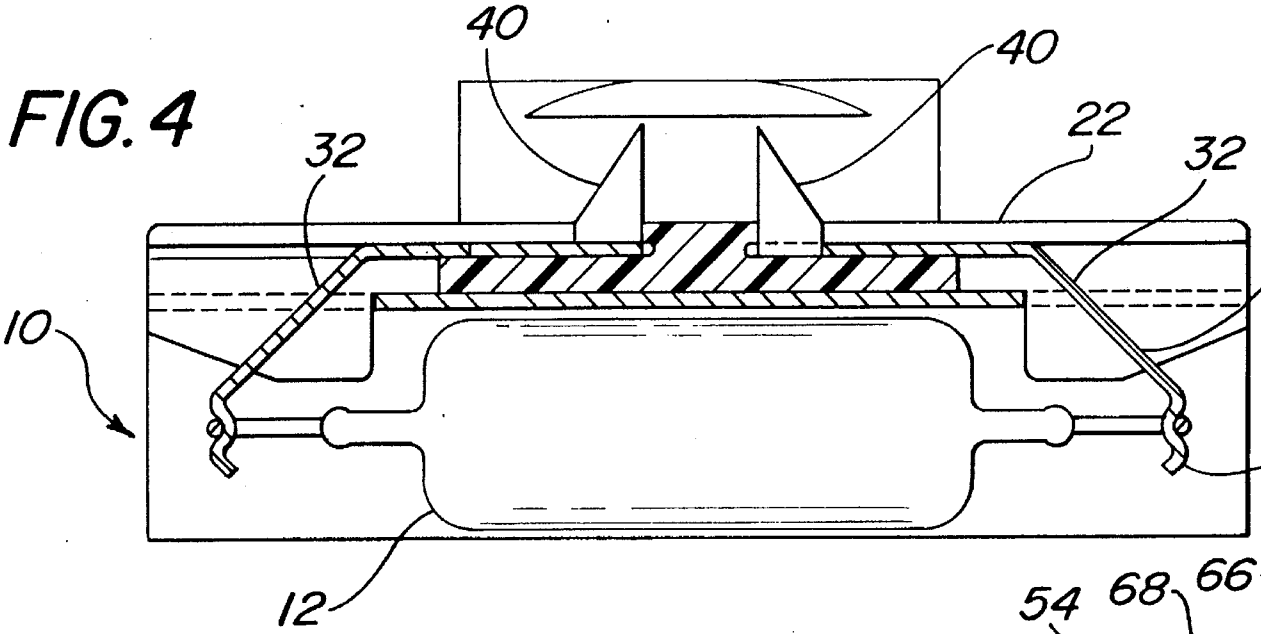
FIG. 4 is a sectional side view of the bulb socket assembly, taken along line 4—4 in FIG. 3.

FIG. 4 shows a sectional side view of the bulb socket assembly 10 with a bulb 12 attached thereto, taken along line 4-4 in FIG. 3. This view more clearly shows the electrical connectors 32 disposed within the housing 22 and the manner in which they function as a unitary conductive path from the prongs 40 to the distal end 42 of the spring tab portion 36.

Figure 5:
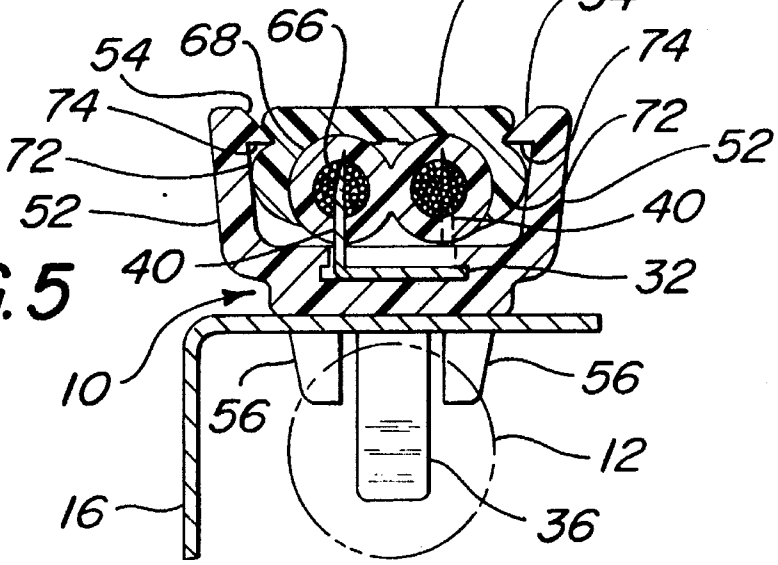
FIG. 5 is sectional end view of the bulb socket assembly, taken along line 5—5 of FIG. 3.

FIG. 5 shows a sectional end view of the bulb socket assembly, taken along line 5—5 of FIG. 3. One of the prongs 40 and the bulb 12 are shown in phantom. This view more clearly shows the prongs 40 which pierce the insulation 68 of the electrical cables 20 and penetrate the cable's conductive wiring 66. This view also more clearly shows how the assembly 10 attaches to the channel 18. The housing tabs 52 surround the shoulders 72 of the channel 18. The tab projections 54 are seated into the shoulder grooves 74. Also visible in FIG. 5 are reflector 16, two retaining rails 56 and the spring tab portion 36 of the electrical connector 32.

FIG. 6 shows a bottom view of housing 22 (absent the reflector 16) with the connectors 32 exploded from the housing 22. FIG. 6, along with FIG. 2, best illustrates the way in which the base portion 38 of each connector 32 attaches to the lower surface 28 of the housing 22.

FIG. 6 shows the entire area of the impressions or grooved regions 58 and 60. (A portion of those regions are hidden underneath the base portions 38 of the electrical connectors 32 in FIG. 3.) Each grooved region 58 and 60 includes an outermost grooved region 76 and an inner grooved region 78. The outermost grooved region 76 coincides with the area of the cut-out 34. The inner grooved region 78 extends from about midway of the grooved region 58, 60 to the middle region 64 of the housing's lower surface 28. The groove depth is constant throughout the grooved regions 58 and 60. The groove depth is best shown in FIG. 2, labelled as 80. The groove has a width $w_1$. The connector's base portion 38 has a width $w_2$ which is slightly less than the groove width $w_1$ so as to allow the base portion 38 to fit snugly therein.

To prevent a fully inserted connector 32 from falling out of a grooved region 58 or 60, a pair of lips 82 extend inward from a portion of each side of the tracks 62. As best shown in FIG. 3, the lips 82 extend over the connector's base portion 38, thereby locking it in place. The lips 82 are formed by merely increasing the width of the outer surface of the track 62, along the inner grooved region 78. There is no lip on the outermost grooved region 76.

In the disclosed embodiment of the invention, the lip 82 is formed gradually. That is, its width gradually increases as one moves closer to the middle region 64. However, the lip 82 may be formed abruptly. At its maximum, the lips 82 reduce the width between the outer facing surface of the tracks 62 to a width $w_3$ which is slightly less than the connector's base portion width $w_2$. In this manner, a bally inserted connector 32 cannot fall out from the housing 22 by slipping between the tracks 62.

Nor can fully inserted connectors 32 slide back out of the groove between the tracks 62. First, the tight fit of the connector's base portion 38 between the tracks 62 (due to the connector's base portion width $w_2$ being only slightly less than the groove width $w_1$) inhibits such lateral movement. Second, lock tabs 84 are formed in a central region of the connector base 38 by striking out a portion of the base. These lock tabs 84 further inhibit lateral movement of a fully inserted connector 32.

The type of materials employed to construct the novel assembly 10 will depend upon the particular application. The housing 22 may be constructed of any rigid nonconducting material. One suitable type of material is molded polycarbonate. One suitable type of material for the optional reflector 16 is highly polished anodized aluminum. One suitable material for the channel 18 is a resin sold under the trademark Noryl®.

The housing base 24 has an overall shape which is similar to the shape of the bulb 12 mounted thereon. However, it should be recognized that the housing base 24 can have other shapes. It is only necessary that the housing base 24 be constructed so that connectors 32 are attachable thereto in a manner similar to that described above. Likewise, the housing tabs 52 can be any length so long as they allow the housing 22 to snap onto the channel 18.

The novel snap-on bulb socket assembly 10 is particularly suitable for use in a low voltage lighting system such as a 12V linear lighting system providing surface mounted illumination.

The snap-on bulb socket assembly 10 described above allows a baseless bulb to be connected to electrical cables without any tools. The assembly 10 includes a novel housing which attaches the assembly to the cables and which holds electrical conductors therein. Furthermore, the electrical connector are of a one piece construction and do not require any assembly or crimping to make an electrical connection between the cables and the bulb.

The present invention may be embodied in other specific forms without departing from the spirit or essential attributes thereof and, accordingly, reference should be made to the appended claims, rather than to the foregoing specification, as indicating the scope of the invention.

We claim:

1. A baseless cartridge bulb socket assembly for attachment to a pair of insulated electrical cables, the assembly comprising:

(a) a nonconductive housing including a base having a longitudinal axis; and (b) two electrical connectors supported by the base for receiving therebetween a baseless cartridge bulb in electrical connection between the cables, each connector being a unitary conductive piece including (i) a spring tab portion having a distal end for accepting a contact pin of a cartridge bulb and a proximal end, (ii) a base portion having first and second ends, the first end being integral with the proximal end of the spring tab portion, and (iii) a spiked prong extending outwardly from the base portion for piercing the insulation of one of the pair of cables when the assembly is brought into contact with the cables and making conductive contact with said one of the pair of cables, said spring tab portions extending along said longitudinal axis in opposite directions.

2. A socket assembly according to claim 1 wherein the housing base has a first surface adapted to face the bulb and a second surface adapted to face the cables, the base portion of the connector being flat and planar and extending parallel to the second surface.

3. A socket assembly according to claim 2 wherein the second surface includes a pair of impressions, each of the base portions of the connectors mounted in one of the impressions.

4. A socket assembly according to claim 3 wherein the second surface includes a non-impressed region which separates the pair of impressions, and thus the second surface into two electrically isolated sides, one connector being associated with each side.

5. A socket assembly according to claim 4 wherein the second end of the base portion is adjacent to the non-impressed region.

6. A socket assembly according to claim 3 wherein the second surface includes lips extending over the impressions for inhibiting movement of the connectors in a direction perpendicularly outward from the second surface.

7. A socket assembly according to claim 1 wherein the prong extends from a corner of the second end of the base portion.

8. A socket assembly according to claim 1 wherein each prong achieves a conductive contact with a different one of the pair of cables.

9. A socket assembly according to claim 1 wherein the distal end of the spring tab portion includes a seating notch for accepting a loop-type contact pin of the cartridge bulb.

10. A socket assembly according to claim 1 further comprising (c) a reflector attached to the housing.

11. A baseless cartridge bulb socket assembly for attachment to a channel holding a pair of insulated electrical cables, the assembly comprising:

(a) a nonconductive housing including a base having a longitudinal axis and sidewalls for attaching to the channel; and (b) two electrical connectors supported by the base for receiving therebetween a baseless cartridge bulb in electrical connection between the cables, each connector being a unitary conductive piece including (i) a spring tab portion having a distal end for accepting a contact pin of a cartridge bulb and a proximal end, (ii) a base portion having first and second ends, the first end being integral with the proximal end of the spring tab portion, and (iii) a spiked prong extending outwardly from the base portion for piercing the insulation of one of the pair of cables when the assembly is attached to the channel and making conductive contact with said one of the pair of cables, said spring tab portions extending along said longitudinal axis in opposite directions.

12. A socket assembly according to claim 11 wherein the base has a first surface adapted to face the bulb and a second surface adapted to face the cables, the base portion of the connector being flat and planar and extending parallel to the second surface.

13. A socket assembly according to claim 12 wherein the second surface includes a pair of impressions, each of the base portions of the connectors mounted in one of the impressions.

14. A socket assembly according to claim 13 wherein the second surface includes a non-impressed region which separates the pair of impressions, and thus the second surface, into two electrically isolated sides, one connector being associated with each side.

15. A socket assembly according to claim 14 wherein the second end of the base portion is adjacent to the non-impressed region.

16. A socket assembly according to claim 13 wherein the second surface includes lips extending over the impressions for inhibiting movement of the connectors in a direction perpendicularly outward from the second surface.

17. A socket assembly according to claim 11 wherein the prong extends from a corner of the second end of the base portion.

18. A socket assembly according to claim 11 wherein each prong achieves a conductive contact with a different one of the pair of cables.

19. A socket assembly according to claim 11 further comprising (c) a reflector attached to the housing.

20. A socket assembly according to claim 11 wherein the distal end of the spring tab portion includes a seating notch for accepting a loop-type contact pin of the cartridge bulb.

21. A baseless cartridge bulb socket assembly for attachment to a channel holding a pair of insulated electrical cables, the assembly comprising:

(a) a nonconductive channel engaging member having a longitudinal axis; and (b) two electrical connectors supported by the engaging member for receiving therebetween a cartridge bulb in electrical connection between the cables, each connector being a unitary conductive piece including (i) a spring tab portion having a distal end for accepting a contact pin of a cartridge bulb and a proximal end, (ii) a planar base portion having first and second ends, the first end meeting the proximal end of the spring tab portion, the base portion extending parallel to the member's longitudinal axis; and (iii) a spiked prong extending outwardly from the base portion for piercing the insulation of one of the pair of cables when the assembly is attached to the channel and making conductive contact with said one of the pair of cables.

22. A socket assembly according to claim 21 wherein the channel engaging member includes a base having a first surface adapted to face the bulb and a second surface adapted to face the cables, the base portion of the connector extending parallel to the second surface.

23. A socket assembly according to claim 22 wherein the second surface includes a pair of tracks, the base portion of the connectors mounted between the tracks.

24. A socket assembly according to claim 23 wherein the second surface includes a cross-tie region which separates the second surface into two electrically isolated sides, one connector being associated with each side.

25. A socket assembly according to claim 24 wherein the second end of the base portion is adjacent to the cross-tie region.

26. A socket assembly according to claim 23 wherein the second surface includes lips extending inward from the tracks for inhibiting movement of the connectors in a direction perpendicularly outward from the second surface.

27. A socket assembly according to claim 21 wherein the channel engaging member includes a base and opposed tabs extending from edges of the base, the tabs allowing the engaging member to attach to the channel.

28. A socket assembly according to claim 21 wherein the prong extends from a corner of the second end of the base portion.

29. A socket assembly according to claim 21 wherein each prong achieves a conductive contact with a different one of the pair of cables.

30. A socket assembly according to claim 21 further comprising (c) a reflector attached to the channel engaging member.

31. A socket assembly according to claim 21 wherein the distal end of the spring tab portion includes a seating notch for accepting a loop-type contact pin of the cartridge bulb.

* * * * *